US011131469B2

(12) United States Patent
Yang et al.

(10) Patent No.: US 11,131,469 B2
(45) Date of Patent: Sep. 28, 2021

(54) HUMIDIFIER

(71) Applicant: Shenzhen Chenbei Technology Co., Ltd., Shenzhen (CN)

(72) Inventors: Lin Yang, Shenzhen (CN); Hai Yang, Shenzhen (CN)

( * ) Notice: Subject to any disclaimer, the term of this patent is extended or adjusted under 35 U.S.C. 154(b) by 88 days.

(21) Appl. No.: 16/742,694

(22) Filed: Jan. 14, 2020

(65) Prior Publication Data

US 2020/0224895 A1 Jul. 16, 2020

(30) Foreign Application Priority Data

Jan. 14, 2019 (CN) ..... 201920057738.X

(51) Int. Cl.
*F24F 6/02* (2006.01)
*F24F 6/00* (2006.01)

(52) U.S. Cl.
CPC ..... *F24F 6/02* (2013.01); *F24F 2006/008* (2013.01)

(58) Field of Classification Search
CPC ..... F24F 6/02; F24F 6/14; F24F 2006/008
USPC ..... 261/65, 74, DIG. 65
See application file for complete search history.

(56) References Cited

U.S. PATENT DOCUMENTS 5,291,579 A * 3/1994 Marino ..... F22B 1/284 200/50.01
5,339,383 A * 8/1994 Marino ..... F22B 1/284 261/142
7,219,880 B2 * 5/2007 Huang ..... B05B 17/0615 261/72.1
9,726,390 B2 * 8/2017 Miller ..... A61M 16/16
2020/0094279 A1 * 3/2020 Matsuoka ..... B05B 5/16
2020/0096213 A1 * 3/2020 Liang ..... F24F 6/12
2020/0284451 A1 * 9/2020 Yang ..... F24F 6/02
2020/0378636 A1 * 12/2020 Yang ..... F24F 11/0008

* cited by examiner

*Primary Examiner* — Charles S Bushey
(74) *Attorney, Agent, or Firm* — Tsz Lung Yeung

(57) ABSTRACT

A humidifier includes a main body having an air outlet, and a waterproof arrangement including a cover panel coupled on the air outlet, an upper cover detachably coupled on top of the main body, and a cover body disposed below the cover panel to move between a communicating state and a non-communicating state. At the communicating state when the humidifier is operated, the upper cover is coupled at the main body to push down the cover body away from the cover panel to unseal a communicating slot of the cover panel, such that a vent hole of the upper cover is communicated with the air outlet through the communicating slot. At the non-communicating state for cleaning the humidifier, the upper cover is detached from the main body, such that the communicating slot is closed and sealed by the cover body to water-seal the air outlet.

20 Claims, 2 Drawing Sheets

HUMIDIFIER

CROSS REFERENCE TO RELATED APPLICATION

This is a non-provisional application which claims priority to a Chinese application having an application number of CN 201920057738.X, and a filing date of Jan. 14, 2019, the entire contents of this foreign application is hereby incorporated by reference.

BACKGROUND OF THE PRESENT INVENTION

Field of Invention

The present invention relates a household appliance, and more particularly to a humidifier.

Description of Related Arts

A humidifier, such as a room humidifier, is a household appliance that can increase the humidity (moisture) of a room. The humidifier is individually operated to add moisture to the air for preventing dryness so as to increase users' comfort in a designated room. The humidifier may also be connected to a furnace or a central air conditioning system for humidifying the entire building or multiple rooms.

Currently, air outlets of conventional humidifiers do not have waterproof function. When cleaning and washing the humidifier after the humidifier is disassembled, water may easily enter into internal circuit components of the humidifier through the air outlet, such that the internal circuit components may be short circuited due to the water damage. This may cause malfunction or even burnout of the humidifier.

Therefore, it is necessary to provide a humidifier which has waterproof air outlets.

SUMMARY OF THE PRESENT INVENTION

Certain variations of the present invention provide a humidifier which is capable of preventing water from contacting internal circuit components of the humidifier so as to prevent the malfunction or burnout of the humidifier.

In one aspect of the present invention, it provides a humidifier, comprising:

a main body having an air outlet; and a waterproof arrangement, which comprises:

a cover panel coupled on the air outlet, wherein the cover panel has a communicating slot communicating with the air outlet;

an upper cover detachably coupled on a top side of the main body, wherein the upper cover has a vent hole communicating with the air outlet through the communicating slot; and a waterproof cover which comprises a cover body disposed below the cover panel to move between a communicating state and a non-communicating state, wherein at the communicating state, the upper cover is coupled at the main body to push down the cover body away from the cover panel to unseal the communicating slot, such that the vent hole is communicated with the air outlet through the communicating slot, wherein at the non-communicating state, the upper cover is detached from the main body that the communicating slot is closed and sealed by the cover body to water-seal the air outlet.

This summary presented above is provided merely to introduce certain concepts and not to identify any key or essential features of the claimed subject matter.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

In the following descriptions, it should also be appreciated that the terms "arrange" and "set" in the following description refer to the connecting relationship in the accompanying drawings for easy understanding of the present invention. For example, the "arrange" and "set" can refer to one element directly or indirectly set or arrange on another element. Therefore, the above terms should not be an actual connection limitation of the elements of the present invention.

It should also be appreciated that the terms "center", "length", "width", "thickness", "top", "bottom", "front", "rear", "left", "right", vertical", "horizontal", "upper", "lower", "interior", and "exterior" in the following description refer to the orientation or positioning relationship in the accompanying drawings for easy understanding of the present invention without limiting the actual location or orientation of the present invention. Therefore, the above terms should not be an actual location limitation of the elements of the present invention.

Moreover, it should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Therefore, the above terms should not be an actual connection limitation of the elements of the present invention.

Figure 1:
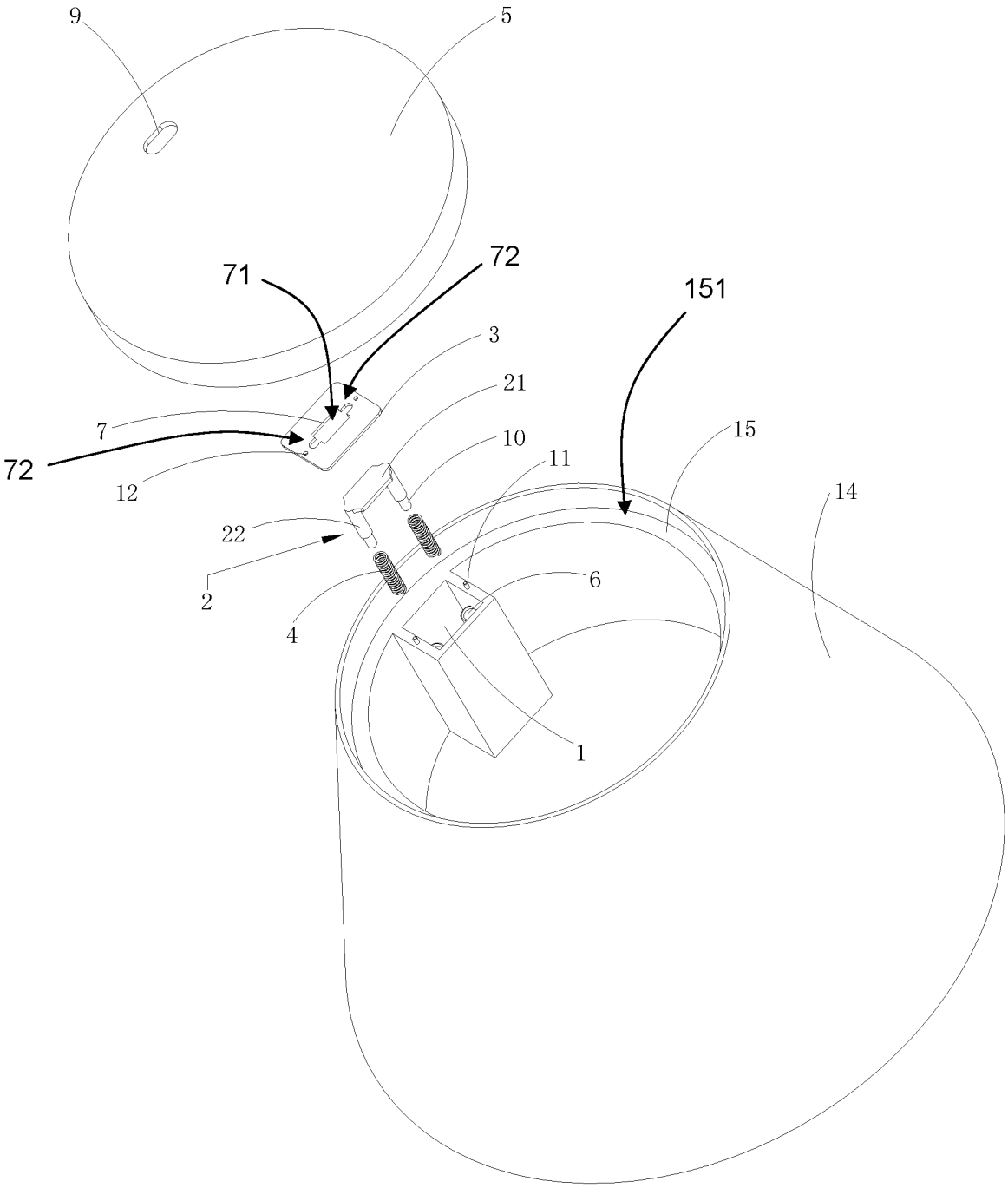
FIG. 1 is an exploded perspective view of a humidifier according to a preferred embodiment of the present invention.
Figure 2:
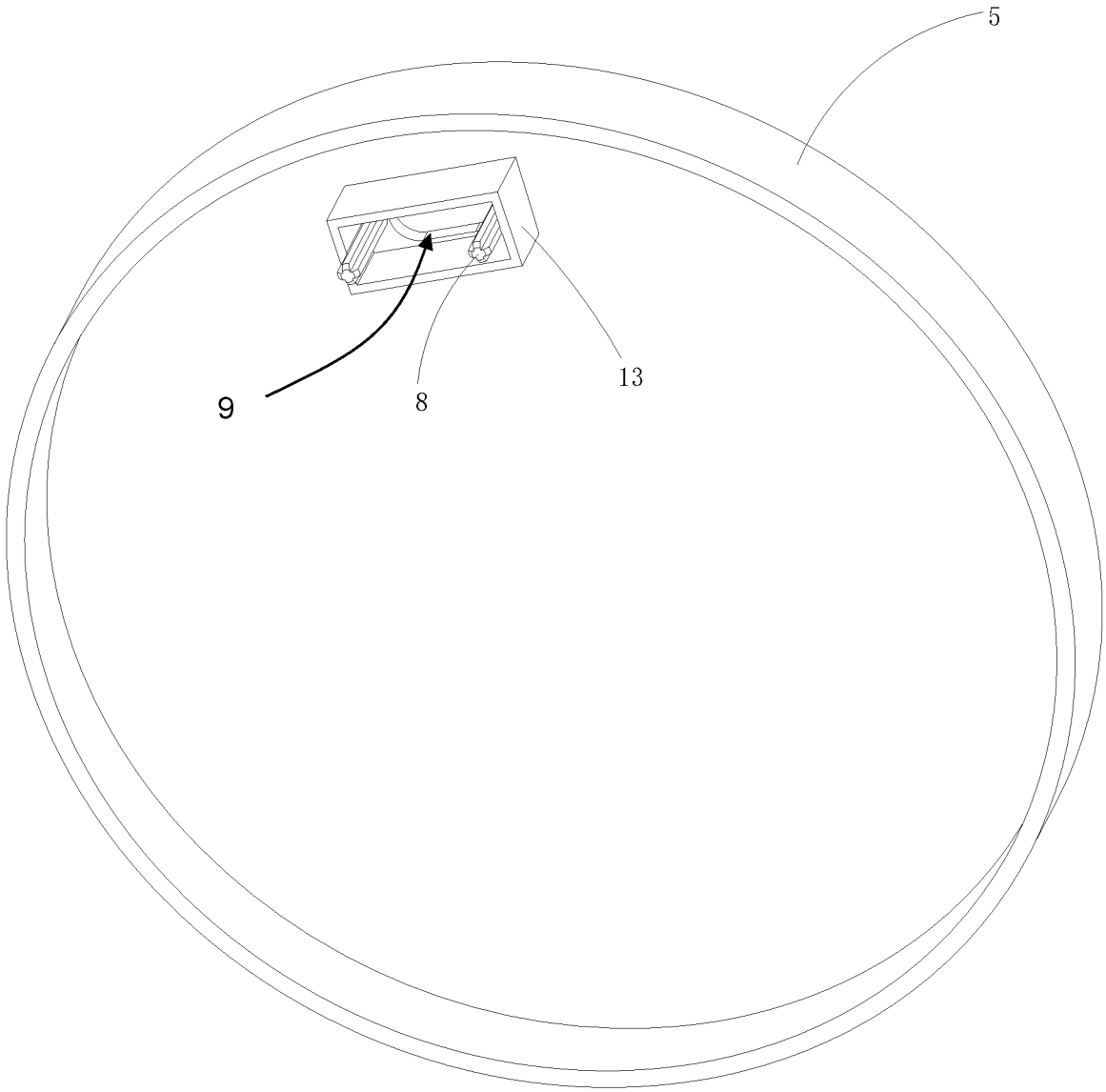
FIG. 2 is a perspective view of an upper cover of the humidifier according to the above preferred embodiment of the present invention.

Referring to FIG. 1 to FIG. 2 of the drawings, a humidifier according to a preferred embodiment of the present invention is illustrated. The humidifier may comprise a main body 14 and a waterproof arrangement. The waterproof arrangement may comprise a waterproof cover 2, a cover panel 3, a resilient element 4, and an upper cover 5. The waterproof cover 2, the cover panel 3, the resilient element 4 and the upper cover 5 may be arranged on an air outlet 1 of the main body 14.

The waterproof cover 2 may comprise a cover body 21 disposed below the cover panel 3 and at least a connection post 22 downwardly extended from the cover body 21. Preferably, two connection posts 22 are spacedly and downwardly extended from the cover body 21. The resilient element 4, which may be a compression spring, may be coaxially coupled at each connection post 22 that the resilient element 4 is located underneath the cover body 21 for applying a resilient force thereto, so as to push the cover body 21 upward. The main body 14 may further have at least a receiving slot 6 formed and set at the air outlet 1, wherein the connection post 4 and the resilient element 4 may together be received in the receiving slot 6.

According to the preferred embodiment, two connection posts 6 may be provided to couple at two compression springs of the resilient elements 4 respectively. In other embodiments, the resilient element 4 can be other type of spring and the number of connection post 22 can varied according to the actual application. The cover panel 3 may be retained at an opening of the air outlet 1 and may be located on the top surface of the cover body 21. The cover panel 3 may have a communicating slot 7 and correspondingly, the upper cover 5 may have at least an abutment post 8 extending downwardly. The abutment post 8 may extend through the communicating slot 7 to bias against the top surface of the cover body 21. The upper cover 5 may have a vent hole 9 aligning and communicating with the air outlet 1 through the communicating slot 7.

Comparing to the conventional humidifier, when the humidifier is operated, the upper cover 5 may be located above the cover body 21 and the cover panel 3 while the abutment post 8 may bias against the top surface of the cover body 21. Due to its own weight of the upper cover 5, the connection post 22 may be driven downwardly by the upper cover 5 to compress the resilient element 4. At this configuration, the air outlet 1, the communicating slot 7 and the vent hole 9 may be maintained at a communicating state for allowing air passing therethrough. In other words, at the communicating state, the upper cover 5 may be detachably coupled at the main body 14 to push down the cover body 21 away from the cover panel 3 to unseal or expose the communicating slot 7, such that the vent hole 9 is communicated with the air outlet 1 through the communicating slot 7. When the upper cover 5 is detached from the main body 14 for cleaning operation, the resilient element 4 may reset and rebounded to its original form due to the lack of the weight of the upper cover 5, such that the cover body 21 is pushed upwardly by the resilient element 4 to close and seal the communicating slot 7 of the cover panel 3. In other words, the cover body 21 may move between a communicating state and a non-communicating state. At the communicating state when the humidifier is operated, the cover body 21 may be moved downwardly via the weight of the upper cover 5 to create a gap between the cover body 21 and the cover panel 3, such that the communicating slot 7 is opened up for allowing air passing from the air outlet 1 to the vent hole 9 through the communicating slot 7.

At the non-communicating state, the humidifier may be arranged for cleaning and washing, and the cover body 21 may be moved upwardly via the resilient force of the resilient element 4 to tightly overlap the cover body 21 with the cover panel 3, such that the communicating slot 7 may be closed and sealed for preventing water entering into the air outlet 1. Therefore, the communicating slot 7 may be closed to water seal the air outlet 1 at a non-communicating state for blocking water passing into the air outlet 1, so as to enhance the safety, simple and convenient features of the humidifier.

As shown in FIG. 1 of the drawings, the waterproof cover 2 may further comprise a protrusion 10 coaxially extended from a free end of the connection post 22 away from the cover panel 3, wherein a diameter of the protrusion 10 is smaller than a diameter of the connection post 22 to form a step shoulder therebetween to bias the resilient element 4. Accordingly, an upper end of the resilient element 4 may be coupled at the protrusion 10 and biased against the step shoulder, and a bottom end of the resilient element 4 may extend into the receiving slot 6 to bias against a bottom wall of the receiving slot 6. Thus, the protrusion 10 may be inserted into the upper end of the resilient element 4 until the upper end of the resilient element 4 is biased against the free end of the connection post 22 so as to couple and retain the resilient element 4 at the connection post 22. When the cover body 21 is downwardly pressed by the upper cover 5, due to the diameter difference between the connection post 22 and the protrusion 10, a stress point is formed between resilient element 4 and the connection post 22 during the compressing and resetting process, such that the resilient element 4 can be effectively compressed and reset.

As shown in FIG. 1 and FIG. 2 of the drawings, two abutment posts 8 may extend to bias against two side portions of the cover body 21 respectively to evenly press the cover body 21 by the upper cover 5 in a balancing manner, so as to evenly compress the two resilient elements 4 at the same time. The vent hole 9 may align with and be located between the two abutment posts 8.

In this preferred embodiment, there may exist two connection posts 22 and two resilient elements 4, wherein the two abutment posts 8 may coaxially align with the connection posts 22 respectively at the same axis, such that the exert forces applied at the connection posts 22 are even and effective, so as to prevent any deformation of the resilient member 4 by a lateral force.

Further, the cover body 21 may have a rectangular shape, wherein the connection post 22 is integrally extended from a surrounding edge of the cover body 21. The communicating slot 7 may be constructed to have a longitudinal rectangular slot portion 71 and two semi-circular slot portions 72 extended from two longitudinal sides of the longitudinal rectangular slot portion 71 respectively to match with the shape of the communicating slot 7 with the shape of the cover body 21, such that the communicating slot 7 can be completely closed by the cover body 21. Accordingly, the two abutment posts 8 may extend through the two semi-circular slot portions 72 respectively to bias against the cover body 21. It is worth mentioning that in other variations, the cover body 21 and the communicating slot 7 may also be set or configured to other shapes, as long as the shape of the cover body 21 and the shape of the communicating slot 7 are matched and consistent.

Furthermore, as shown in FIG. 1 of the drawings, the main body 14 may further comprise a positioning post 11 formed at an opening rim of the air outlet 1, and correspondingly, the cover panel 3 may further have a positioning slot 12, wherein the positioning post 11 may be coupled at the positioning slot 12 to retain the position of the cover panel 3 at the opening of the air outlet 1.

As shown in FIG. 2 of the drawings, the upper cover 5 further comprises a boundary wall 13 extending downwardly, wherein the abutment post 8 may be encircled by the boundary wall 13. When the upper cover 5 is placed on top of the air outlet 1, the boundary wall 13 is biased against the cover panel 3, so as to prevent any air leakage from the main body 14. In other words, a height of the boundary wall 13 may be shorter than a height of the abutment post 8, such that when the boundary wall 13 is biased against the cover panel 3, the abutment post 8 is extended through the communicating slot 7 to bias against the top surface of the cover body 21. The vent hole 9 may also be encircled by the boundary wall 13.

As shown in FIG. 1 of the drawings, the main body 14 may further have a sink hole 15 formed at a top side of the main body 14 to receive the upper cover 5 so as to allow the upper cover 5 being easily coupled and positioned at the top side of the main body 14. Preferably, a supporting brim 151 may inwardly and integrally extend within an inner surface of the main body 14 at the top side thereof to define the sink hole 15 so as to support the upper cover 5 at the supporting brim 151.

As shown in FIG. 1 of the drawings, the main body 14 may have a circular cross section, wherein an upper diameter of the main body 14 may be smaller than a bottom diameter thereof.

The present invention, while illustrated and described in terms of a preferred embodiment and several alternatives, is not limited to the particular description contained in this specification. Additional alternative or equivalent components could also be used to practice the present invention.

What is claimed is:

1. A humidifier, comprising:

a main body having an air outlet; and a waterproof arrangement, which comprises:

a cover panel coupled on said air outlet, wherein said cover panel has a communicating slot communicating with said air outlet;

an upper cover detachably coupled on a top side of said main body, wherein said upper cover has a vent hole communicating with said air outlet through said communicating slot; and a waterproof cover which comprises a cover body disposed below said cover panel to move between a communicating state and a non-communicating state, wherein at said communicating state, said upper cover is coupled at said main body to push down said cover body away from said cover panel to unseal said communicating slot, such that said vent hole is communicated with said air outlet through said communicating slot, wherein at said non-communicating state, said upper cover is detached from said main body that said communicating slot is closed and sealed by said cover body to water-seal said air outlet.

2. The humidifier, as recited in claim 1, wherein said waterproof cover further comprises a resilient element located underneath said cover body for applying a resilient force thereto, so as to push said cover body upward.

3. The humidifier, as recited in claim 2, wherein said waterproof cover further comprises a connection post downwardly extended from said cover body to couple with said resilient element.

4. The humidifier, as recited in claim 3, wherein said waterproof cover further comprises a protrusion coaxially extended from a free end of said connection post away from said cover panel to insert into said resilient element, wherein a diameter of said protrusion is smaller than a diameter of said connection post to form a step shoulder therebetween to bias said resilient element when said protrusion is inserted into said resilient element.

5. The humidifier, as recited in claim 4, wherein said main body further has a receiving slot set at said air outlet, wherein said connection post and said resilient element are together received in said receiving slot.

6. The humidifier, as recited in claim 4, wherein said resilient element is a compression spring that said protrusion is inserted into an upper end of said compression spring.

7. The humidifier, as recited in claim 5, wherein said resilient element is a compression spring that said protrusion is inserted into an upper end of said compression spring.

8. The humidifier, as recited in claim 1, wherein said upper cover has at least an abutment post extending downwardly, wherein said abutment post is extended through said communicating slot to bias against a top surface of said cover body so as to push said cover body downwardly to unseal said communicating slot.

9. The humidifier, as recited in claim 5, wherein said upper cover has at least an abutment post extending downwardly, wherein said abutment post is extended through said communicating slot to bias against a top surface of said cover body so as to push said cover body downwardly to unseal said communicating slot.

10. The humidifier, as recited in claim 9, wherein said abutment post is coaxially aligned with said connection post at the same axis.

11. The humidifier, as recited in claim 8, wherein said communicating slot is constructed to have a longitudinal rectangular slot portion and two semi-circular slot portions extended from two longitudinal sides of said longitudinal rectangular slot portion respectively, wherein there are two said abutment posts spacedly extended from said upper cover to extend through said two semi-circular slot portions respectively to bias against said cover body.

12. The humidifier, as recited in claim 10, wherein said communicating slot is constructed to have a longitudinal rectangular slot portion and two semi-circular slot portions extended from two longitudinal sides of said longitudinal rectangular slot portion respectively, wherein there are two said abutment posts spacedly extended from said upper cover to extend through said two semi-circular slot portions respectively to bias against said cover body.

13. The humidifier, as recited in claim 8, wherein said upper cover further comprises a boundary wall extending downwardly, wherein said abutment post is encircled by said boundary wall, wherein when said upper cover is placed on top of said main body, said boundary wall is biased against said cover panel, so as to prevent an air leakage from said air outlet.

14. The humidifier, as recited in claim 10, wherein said upper cover further comprises a boundary wall extending downwardly, wherein said abutment post is encircled by said boundary wall, wherein when said upper cover is placed on top of said main body, said boundary wall is biased against said cover panel, so as to prevent an air leakage from said air outlet.

15. The humidifier, as recited in claim 13, wherein a height of said boundary wall is shorter than a height of said abutment post, such that when said boundary wall is biased against said cover panel, said abutment post is extended through said communicating slot to bias against said top surface of said cover body.

16. The humidifier, as recited in claim 14, wherein a height of said boundary wall is shorter than a height of said abutment post, such that when said boundary wall is biased against said cover panel, said abutment post is extended through said communicating slot to bias against said top surface of said cover body.

17. The humidifier, as recited in claim 1, wherein said main body further comprises a positioning post formed at an opening rim of said air outlet, wherein said cover panel further has a positioning slot, wherein said positioning post is coupled at said positioning slot to retain a position of said cover panel at an opening of said air outlet.

18. The humidifier, as recited in claim 16, wherein said main body further comprises a positioning post formed at an opening rim of said air outlet, wherein said cover panel further has a positioning slot, wherein said positioning post is coupled at said positioning slot to retain a position of said cover panel at an opening of said air outlet.

19. The humidifier, as recited in claim 1, wherein said main body further has a sink hole formed at a top side of said main body to receive said upper cover so as to allow said upper cover being coupled and positioned at said top side of said main body, wherein said main body has a supporting brim extended within an inner surface of said main body at said top side thereof to define said sink hole so as to support said upper cover at said supporting brim.

20. The humidifier, as recited in claim 18, wherein said main body further has a sink hole formed at a top side of said main body to receive said upper cover so as to allow said upper cover being coupled and positioned at said top side of said main body, wherein said main body has a supporting brim extended within an inner surface of said main body at said top side thereof to define said sink hole so as to support said upper cover at said supporting brim.

* * * * *